US005456886A

United States Patent [19]

Burns

[11] Patent Number: 5,456,886

[45] Date of Patent: Oct. 10, 1995

[54] STOPPER FOR SMALL DIAMETER BLOOD COLLECTION TUBE

[75] Inventor: James A. Burns, Elizabeth, N.J.

[73] Assignee: Becton Dickinson and Company, Franklin Lakes, N.J.

[21] Appl. No.: 226,239

[22] Filed: Apr. 11, 1994

Related U.S. Application Data

[63] Continuation of Ser. No. 40,725, Mar. 31, 1993, abandoned.

[51] Int. Cl.[6] ..... A61J 1/00; B67B 1/00

[52] U.S. Cl. ..... 422/103; 422/102; 128/764; 128/766

[58] Field of Search ..... 128/763, 764, 128/765, 766, 771, 912; 422/102, 99, 103

[56] References Cited

U.S. PATENT DOCUMENTS

| | | | |
|---|---|---|---|
| 4,134,512 | 1/1979 | Nugent | 128/764 |
| 4,576,595 | 3/1986 | Aas et al. | 215/355 |
| 4,682,703 | 7/1987 | Kasai et al. | 215/247 |
| 4,863,453 | 9/1989 | Beager et al. | 128/764 |
| 4,893,636 | 1/1990 | Cook et al. | 128/764 |

*Primary Examiner*—Timothy M. McMahon
*Assistant Examiner*—N. Bhat
*Attorney, Agent, or Firm*—Alan W. Fiedler

[57] ABSTRACT

A stopper for sealing an open end of a small internal diameter blood collection tube. The stopper includes a needle lead-in hole that guides the needle through an upper portion of the stopper to a penetration location at the bottom of the lead-in hole and to the open end of the small internal diameter tube. The stopper also includes a tube receiving chamber in its lower portion for receiving and sealing the open end of the tube. After the needle has penetrated the penetration location it passes through a resealable diaphragm section before entering the open end of the tube. The lead-in hole and tube receiving chamber both have beveled edges on their openings that aid in directing the needle and tube, respectively, into the stopper.

16 Claims, 2 Drawing Sheets

STOPPER FOR SMALL DIAMETER BLOOD COLLECTION TUBE

This application is a continuation of application Ser. No. 08/040,725, filed Mar. 31, 1993, now abandoned.

BACKGROUND OF THE INVENTION

1. Field of the Invention

The present invention relates to a stopper for a small diameter blood collection tube and, more particularly, relates to a stopper for a blood collection tube having an internal diameter that is no larger than about 0.250".

2. Background Description

Blood collection tubes are commonly used by a doctor, phlebotomist or nurse to draw a sample of body fluid from a patient in a hospital or doctor's office for diagnostic testing. Generally the blood collection tube contains a vacuum that aids in drawing the body fluid from a puncture wound in the patient into the tube. For example, an evacuated blood collection tube is commonly used with a double-ended needle, wherein one end of the needle is inserted into the patient's arm and the other end is used to pierce through a stopper on the open end of the tube. When the needle enters the evacuated tube a predetermined amount of blood is drawn from the patient into the tube based upon the amount of vacuum in the tube. As vacuum in the tube increases, greater amounts of body fluid can be drawn into the tube. Because of the importance of retaining the predetermined amount of vacuum in the tube during shipping and storage of the tube, it is important that the stopper on the tube fits securely over the open end of the tube and maintains the vacuum in the tube.

It is also important that the vacuum level is maintained in the tube to draw the desired volume of blood into the tube to limit any discomfort to the patient. Since the patient has one end of the needle in the skin during the drawing operation, the patient may experience pain during the operation which can be minimized by performing the operation as quickly as possible. If the vacuum in the tube is deficient, however, subsequent removal of the tube and insertion of another tube would be necessary which would prolong the unpleasant procedure.

As those skilled in the field of blood collection are aware, the use of smaller diameter tubes for collecting small volumes of blood is becoming more desirable. In particular, tubes having an internal diameter of no greater than about 0.250" are preferred for some types of blood collection. Therefore, there is an ever increasing need for a stopper for these small diameter tubes that is capable of maintaining a predetermined vacuum within the tube. In addition, because of the small diameter opening in these tubes there is a problem with directing the needle through the stopper and into the small opening in the tube. Currently, a special adapter must be mounted on top of the stopper to align the tube during needle insertion.

SUMMARY OF THE INVENTION

The present invention overcomes the problems identified in the background material by providing a stopper for blood collection tubes having a small diameter, i.e., an internal diameter no greater than 0.250", that does not require the use of a special adapter to insert a needle and provides sufficient sealing action.

A preferred embodiment of a stopper according to the present invention is capable of receiving the outer diameter of an evacuated blood collection tube having a small internal diameter. Some of the features of a preferred stopper according to the present invention include an interference fit between the internal diameter of the stopper and the tube's outer diameter to maintain the vacuum within the tube and an internal stress on the material in the stopper caused by the tube being inserted into the stopper which provides a positive effect upon needle penetration force through the diaphragm section of the stopper. In addition, the stopper is provided with a lead-in hole to facilitate directing the needle through the diaphragm of the stopper and into the small internal diameter opening in the tube.

These and other aspects, features and advantages of the present invention will become apparent from the following detailed description taken in conjunction with the accompanying drawings.

DETAILED DESCRIPTION

Figure 1:
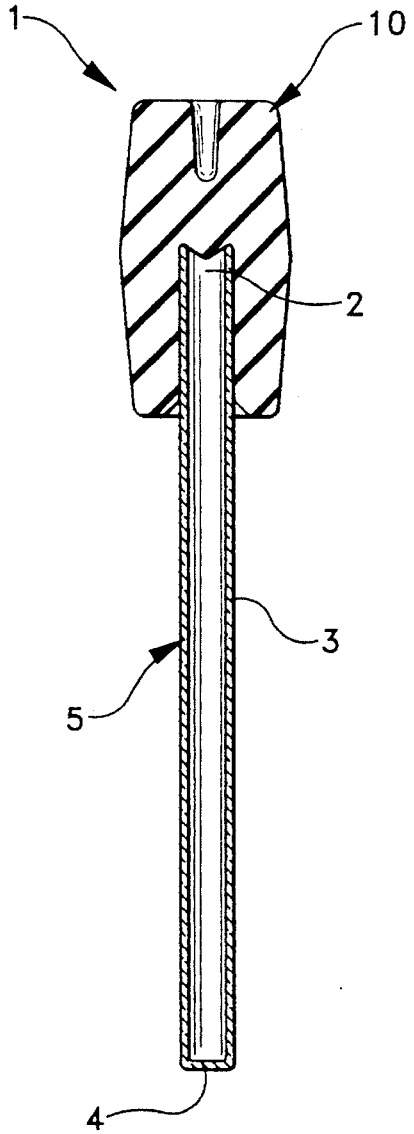
FIG. 1 is a cross-sectional view of a blood collection assembly having a preferred stopper according to the present invention.

FIG. 1 is a cross-sectional view of a blood collection assembly 1 having a blood collection tube 5 and a preferred stopper 10 according to the present invention. As shown, blood collection tube 5 includes a closed end 4 connected to an open end 2 by a side wall 3 and is mounted within stopper 10.

Figure 2:
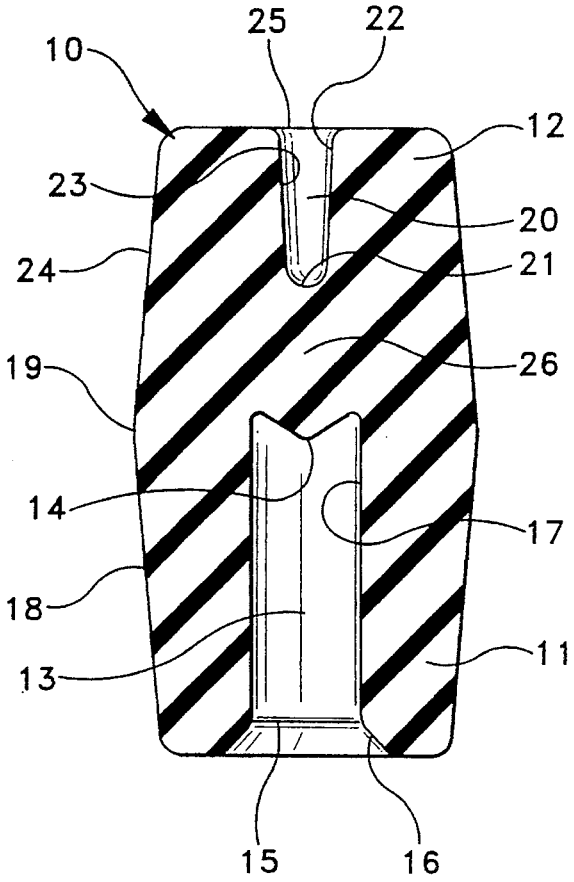
FIG. 2 is an enlarged cross-sectional view of the stopper shown on the assembly in FIG. 1.

FIG. 2 is an enlarged cross-sectional view of stopper 10 and shows more of the details of stopper 10. In particular, stopper 10 includes an upper portion 12 and a lower portion 11 having a receiving chamber 13 therein with a wall surface 17. The bottom of receiving chamber 13 has an annular opening 15 surrounded by a beveled edge 16 that directs open end 2 of tube 5 into chamber 13 when stopper 10 is being mounted on tube 5. A cone-shaped seal 14 is positioned at the top of chamber 13 to receive and seal open end 2, when tube 5 is fully-inserted into chamber 13. The interaction between open end 2 and cone-shaped seal 14 forms a primary seal to maintain the vacuum within tube 2, and the interaction between side wall 3 and wall surface 17 provides a secondary seal to maintain the vacuum.

Figure 3:
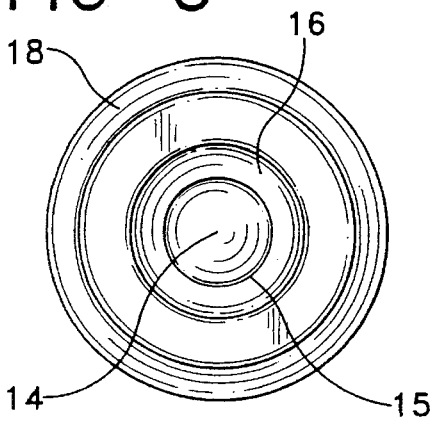
FIG. 3 is a bottom end view of the stopper shown in FIG. 2.

FIG. 3 is a bottom end view of stopper 10 showing cone-shaped seal 14 at the base of chamber 13 through opening 15 near the center of stopper 10, and beveled surface 16 which surrounds opening 15 and aids the user in directing tube 2 into chamber 13. In addition, FIGS. 2 and 3 show a lower outer wall 18 on lower portion 11 that is tapered in diameter from an outer edge 19 to the bottom of stopper 10 to provide increased flexibility in lower portion 11 when inserting tube 5 into chamber 13 and provide an internal stress on the material in stopper 10 caused by tube 5 being inserted into stopper 10. The internal stress in stopper 10 is important since it provides a positive effect upon needle penetration force through diaphragm 26 of stopper 10 by reducing the force that is necessary to push the needle through diaphragm 26. However, diaphragm 26 also functions to receive the needle after the needle has penetrated seal 14, the needle receiving area, and direct the needle along a path through diaphragm 26 into open end 2 of tube 5. After the needle has been withdrawn from stopper 10, diaphragm 26 reseals the path taken by the needle to retain the seal on open end 2 of tube 5.

As shown in FIG. 2, upper portion 12 of stopper 10 includes a needle lead-in hole 20 having a curved needle receiving area 21 at the bottom of hole 20 connected to an opening 25 at the top by an inner wall 23. Opening 25 has a beveled edge 22 which enlarges the area through which the needle is received by stopper 10 so that the needle will not be obstructed during its movement through hole 20, until it reaches needle receiving area 21 at the bottom of hole 20. After the needle has entered opening 25 it is directed through hole 20 by inner wall 23 until in comes into contact with needle receiving area 21. The user then applies sufficient pressure to the needle to force the needle into and through diaphragm section 26. Diaphragm 26 is located between needle receiving area 21 at the bottom of hole 20 and seal 14 at the base of chamber 13. The needle exits diaphragm 26 at seal 14 and then enters open end 2 of tube 5, so that body fluid is drawn through the needle into tube 5 due to the vacuum in tube 5.

Figure 4:
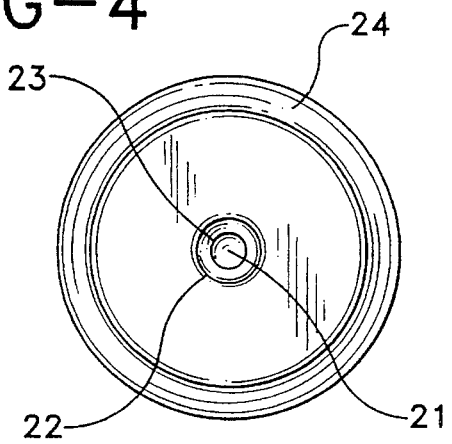
FIG. 4 is a top end view of the stopper shown in FIG. 2.

FIG. 4 is a top end view of stopper 10 and more clearly shows the relationship between beveled edge 22 of opening 25, inner wall 23 and needle receiving area 21 in needle lead-in hole 20. In addition, FIGS. 2 and 4 show an upper outer wall 24 on upper portion 12 that is tapered in diameter from outer edge 19 to the top of stopper 10 to form a tapered upper portion 12 that provides means for a user to hold and push stopper 10, when inserting tube 5 into chamber 13.

Figure 5:
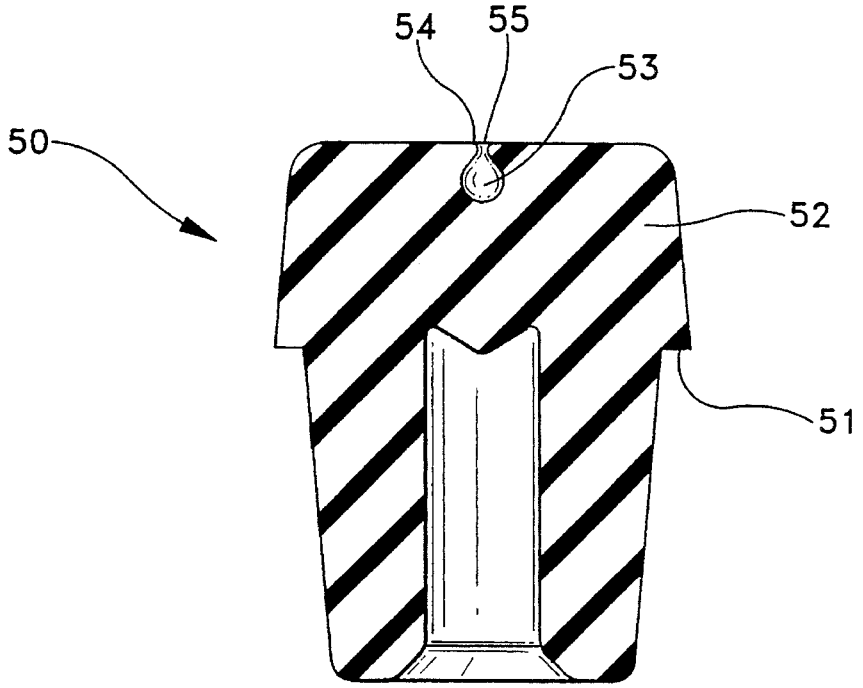
FIG. 5 is an enlarged cross-sectional view of a first alternative embodiment of a stopper according to the present invention.
Figure 6:
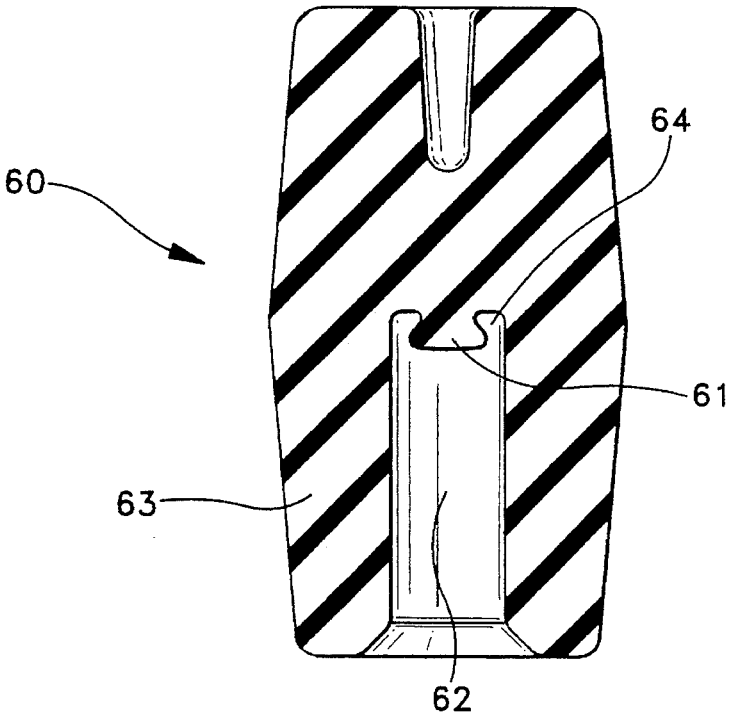
FIG. 6 is an enlarged cross-sectional view of a second alternative embodiment of a stopper according to the present invention for sealing a tube having a bead around its open end.

FIGS. 5 and 6 are cross-sectional views of alternative embodiments of closures according to the present invention. Many of the elements of closures 50 and 60 shown in FIGS. 5 and 6, respectively, are similar to corresponding elements in closure 10 in FIGS. 1–4, and therefore are not being identified by reference numbers. The following description of closures 50 and 60 is primarily directed to the modifications in each closure.

Closure 50 shown in FIG. 5 has an upper portion 52 that is shorter than upper portion 12 in closure 10 and includes a lower edge 51 that aids in orienting closure 50 when it is being fed during production. The reduced height of upper portion 52 has been found to reduce the gas permeability of the closure and thereby improve the sealing properties of the closure. Upper portion 52 also includes an opening 55 that has a smaller diameter than opening 25 in closure 10 and leads to a body fluid trap 53 within closure 50. Opening 55 on body fluid trap 53 also includes a rim 54 that serves to prevent user contamination of trap 53 and retain residue body fluid within trap 53 after closure 50 has been used, which prevents the fluid from inadvertently flowing out of opening 55. Opening 55 in combination with the shape and position of trap 53 within closure 50 also provide the feature of directing a needle through closure 50 into open end 2 of tube 5, as described above with respect to closure 10.

Closure 60 shown in FIG. 6 is similar to closure 10, but has a seal 61 within a chamber 62 in a lower portion 63 that is different from seal 14 shown in closure 10. Closure 60 is designed to seal an open end of a tube having an inside bead and/or an outside bead around open end 2. Seal 61 includes an undercut 64 that serves to receive such a bead and thereby increase the locking action between closure 60 and tube 5.

Stoppers 10, 50 and 60 are manufactured using conventional manufacturing techniques and are preferably made of bromo butyl rubber, which is substantially gas impermeable so to properly preserve the predetermined vacuum within tube 5 when sealed by one of these stoppers. Bromo butyl rubber is also preferred since it is substantially flexible so that the stopper can be easily mounted onto and seal end 2 of tube 5. It is to be understood, however, that the use of bromo butyl rubber in manufacturing these stoppers is merely exemplary and that various other materials could also be used so long as they provide gas permeability and sufficient flexibility.

In the foregoing discussion, it is also to be understood that the above-described embodiments are simply illustrative of a stopper that is capable of sealing the open end of a tube to retain a vacuum within the tube and providing means for a needle to penetrate the top of the stopper and be directed into the open end of the tube to perform the blood collection operation. Other suitable variations and modifications could be made to these embodiments and still remain within the scope of the present invention.

What is claimed is:

1. A stopper for sealing an open end of and maintaining a vacuum within an evacuated blood collection tube, said stopper comprising:

an upper portion having means for guiding a needle from a needle receiving area in said upper portion into the open end of the tube, said guiding means comprising a needle lead-in hole having a hole diameter with said needle receiving area being located at the bottom of said needle lead-in hole; and a lower portion having a tube holding chamber for receiving therein the open end of the tube and means for sealing the open end of the tube and maintaining the vacuum therein, said tube holding chamber having a chamber diameter that is larger than the hole diameter of said needle lead-in hole to ensure that the needle enters the open end of the tube, when the tube is contained within said tube holding chamber.

2. A stopper according to claim 1, wherein the open end of the tube has an internal diameter of about 0.250 inches, which is capable of being sealed by said sealing means to maintain the vacuum within the tube.

3. A stopper according to claim 1, further comprising a diaphragm between said needle receiving area in said upper portion and said sealing means in said lower portion, said diaphragm receiving the needle after the needle penetrates said needle receiving area and directing the needle along a path through said diaphragm into the open end of the tube.

4. A stopper according to claim 3, wherein said sealing means reseals said path through said diaphragm when the needle is withdrawn from said diaphragm.

5. A stopper according to claim 1, wherein said sealing means includes a cone-shaped seal within said chamber.

6. A stopper according to claim 5, wherein the open end of the tube has an internal diameter of about 0.250 inches, which is capable of being sealed by said sealing means to maintain the vacuum within the tube.

7. A stopper according to claim 1, wherein said sealing means includes an undercut for receiving a bead on the open end of the tube to securely seal the open end of the tube.

8. A stopper according to claim 7, wherein the open end of the tube has an internal diameter of about 0.250 inches, which is capable of being sealed by said sealing means to maintain the vacuum within the tube.

9. A stopper according to claim 1, wherein said upper portion further includes a trap surrounding said needle receiving area for capturing residue body fluid that may remain at said needle receiving area when the needle is withdrawn from said stopper.

10. A stopper according to claim 9, wherein said upper portion further includes a rim surrounding said trap to prevent said needle receiving area from being contaminated through accidental contact prior to needle penetration and prevent the residue body fluid from flowing out of said stopper after needle penetration.

11. A stopper according to claim 10, wherein the open end of the tube has an internal diameter of about 0.250 inches, which is capable of being sealed by said sealing means to maintain the vacuum within the tube.

12. A stopper according to claim 1, wherein an opening to said chamber is surrounded by a beveled edge that directs the open end of the tube into said chamber.

13. A stopper according to claim 1, wherein said means for guiding the needle from said needle receiving area in said upper portion into the open end of the tube includes a lead-in hole having an opening with a beveled edge which prevents the needle from being obstructed during its movement through said lead-in hole and helps direct the needle into the open end of the tube.

14. A stopper according to claim 1, further comprising an outer wall having an edge where said upper portion and said lower portion meet, said outer wall expanding in diameter as it approaches said edge.

15. A stopper according to claim 14, wherein said upper portion extends beyond said lower portion at said edge whereby said edge provides an orientation reference during manufacture of said stopper.

16. A stopper for sealing an open end of and maintaining a vacuum within an evacuated blood collection tube, said stopper comprising:

an upper portion having means for guiding a needle from a needle receiving area in said tipper portion into the open end of the tube including a lead-in hole having a predefined hole diameter and an opening with a beveled edge which prevent the needle from being obstructed during its movement through said lead-in hole and help guide the needle into the open end of the tube: and a lower portion having a tube holding chamber for receiving therein the open end of the tube and means for sealing the open end of the tube and maintaining the vacuum therein, said tube holding chamber having an opening surrounded by a beveled edge that directs the open end of the tube into said tube holding chamber and a chamber diameter that is larger than the hole diameter of said lead-in hole to ensure that the needle enters the open end of the tube, when the tube is contained within said tube holding chamber.

* * * * *